US005702265A

United States Patent [19]

Yamaguchi

[11] Patent Number: 5,702,265

[45] Date of Patent: Dec. 30, 1997

[54] CONNECTOR STRUCTURE

[75] Inventor: Noboru Yamaguchi, Shizuoka, Japan

[73] Assignee: Yazaki Corporation, Tokyo, Japan

[21] Appl. No.: 770,157

[22] Filed: Dec. 19, 1996

[30] Foreign Application Priority Data

Dec. 27, 1995 [JP] Japan ..... HEI. 7-341107

[51] Int. Cl.[6] ..... H01R 13/54

[52] U.S. Cl. ..... 439/352; 439/357

[58] Field of Search ..... 439/350–358, 439/345, 372

[56] References Cited

U.S. PATENT DOCUMENTS 5,192,225 3/1993 Suzuki ..... 439/352

5,529,512 6/1996 Mlyniec ..... 439/352

5,584,719 12/1996 Tsuji et al. ..... 439/354

*Primary Examiner*—Hien Vu

*Attorney, Agent, or Firm*—Morgan, Lewis & Bockius LLP

[57] ABSTRACT

A connector structure includes a housing; a rear holder which is coupled to the rear end portion of the housing; and a pair of operating walls which are confronted with both side edges of the free end portion of a locking arm and are adapted to press the free end portion from both sides to bend the locking arm downwardly. The operating walls is bendable with their lower ends as fulcrums which are located below the center of the housing.

3 Claims, 2 Drawing Sheets

CONNECTOR STRUCTURE

BACKGROUND OF THE INVENTION

This invention relates to connector structures, and more particularly to a connector structure having flexible operating walls which elastically deform a locking arm engaged with a mating connector to disengage it from a mating connector.

In general, in a connector, a locking arm provided in one of two connector housings is engaged with an engaging section provided in the other connector housing, so that the two housings are fixedly locked to each other. This locking state can be eliminated by depressing the free end portion of the locking arm from above; that is, by elastically deforming it to the side of the connector housing (hereinafter referred to merely as "housing", when applicable).

In some of the connectors employed in the engine room of an automobile, because of the limitation in space it is necessary to depress the locking arm horizontally to elastically deform the latter.

One example of the connector structure of this type is as shown in FIGS. 4 and 5. A connector body 30 has a locking arm 31 and a pair of operating walls 32 and 32 on an upper surface 30*a*. The operating walls 32 are flexible and located on both sides of the free end portion 31*a* of the locking arm 31. The operating walls 32 has unlocking surfaces 32*a*, respectively, which are curved outwardly. The unlocking surfaces 32*a* are in contact with both side edges of the free end portion 31*a*.

When the pair of operating walls 32 are pushed towards each other, as shown in FIG. 5, they are bent (deformed) in the directions of arrows S with their lower ends 32*b* as fulcrums, respectively. As a result, both side edges of the free end portion 31*a* of the locking arm 31 are pushed by the unlocking surfaces 32*a*, so that the free end portion of the locking arm is slid down the unlocking surfaces 32.

When the locking arm 31 is moved downwardly in the above-described manner, a locking protrusion 33 is disengaged from a locking section 41 of a mating connector 40; that is, the connector body 30 is disengaged from the mating connector 40.

If, in bending the pair of operating walls 32, the operating walls are small in height, then a relatively large force is required to do so. Hence, in order to bend the operating walls 32 with ease, the operating walls must have a certain height. However, to increase the height of the operating walls 32 means to increase the height of the connector body 30 as a whole, and accordingly to make the connector assembly bulky, which is disadvantageous in view of space.

In addition, the increase in height of the operating walls 32 gives rise another problem that the surfaces of prolongations 34 as indicated by the phantom lines in FIG. 5 is easily sunk by thermal contraction when molded.

SUMMARY OF THE INVENTION

In view of the foregoing, an object of the invention is to provide a connector structure which makes it possible to elastically deform (bend) its operating walls without making the connector assembly bulky, and which is free from difficulties attributing to its molding operation.

The foregoing object of the invention has been achieved by the provision of a connector structure comprising: a housing; a locking arm which is integral with the housing, and is engaged with a mating connector, the locking arm being elastically deformed to disengage from the mating connector; and flexible operating walls which are bent towards the locking arm to engage with both side edges of the locking arm, thereby to elastically deform the locking arm, in which the operating walls are formed on a rear holder which is coupled to the rear end portion of the housing, and regulates the movement of terminals accommodated in the housing; and the operating walls are bendable with the lower ends thereof as fulcrums which are located below the center of the housing.

In the connector structure, the locking arm is extended from the rear end face of the housing, the rear holder is substantially U-shaped in a plan view thereof and coupled to the housing from the outside, and the operating walls are a pair of walls of the rear holder which are confronted with each other.

Furthermore, in the connector structure, the rear holder includes a locking wall, and wires connected to the terminals are extended out of the housing after being bent by the locking wall.

When the locking arm extended from the rear end of the housing is pressed by the operating walls of the rear holder from both sides, which is provided separate from the housing, the locking arm thus pressed is moved down the inner surfaces of the operating walls. In this operation, the operating walls are elastically bent with their lower ends as fulcrums which are located below the center of the housing. That is, the operating walls are long enough to elastically bend, and it is unnecessary to lengthen the operating walls above the housing.

As was described above, it is unnecessary to lengthen the operating walls above the housing. Accordingly, the rear holder is free from a difficulty that, when molded, its surfaces are sunk by thermal contraction. In addition, the housing and the rear holder may be different in material from each other, which makes it possible to optionally select the material of the rear holder.

The wires connected to the terminals in the housing are led out after being bent by the locking wall of the rear holder. Hence, even if a tensile force is applied to the wire, it is absorbed or decreased at the bends of the wire, so that the tensile force will not adversely affect the terminal connections.

DETAILED DESCRIPTION OF THE INVENTION

A connector structure, which constitutes a preferred embodiment of the invention, will be described with reference to the accompanying drawings in detail.

Figure 1:
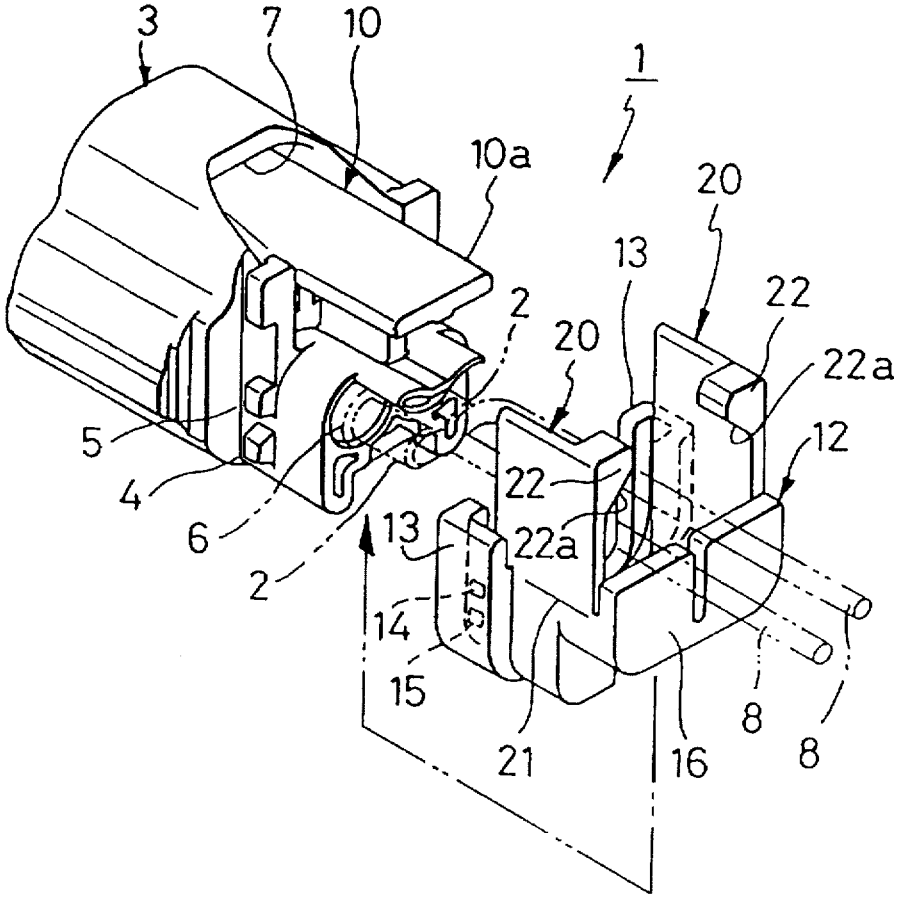
FIG. 1 is an exploded perspective view of a connector structure, which constitutes a preferred embodiment of the invention.
Figure 2:
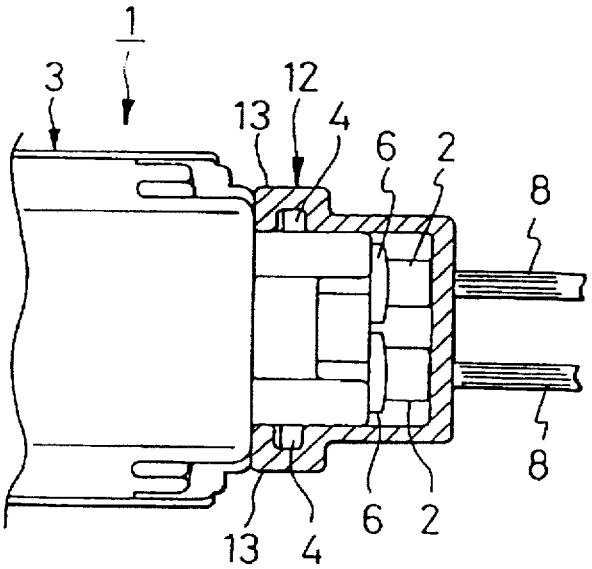
FIG. 2 is a sectional view showing essential components of the connector structure of in FIG. 1 seen from the bottom side thereof.
Figure 3:
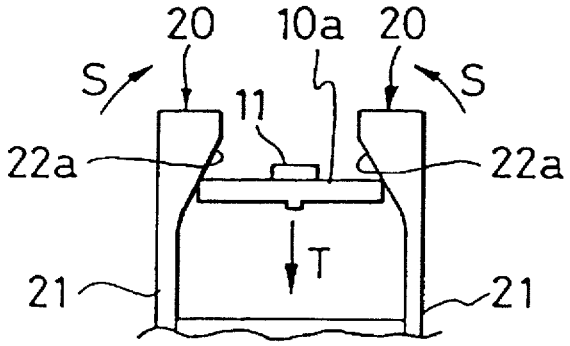
FIG. 3 is a view for explaining the function of the connector structure of FIG. 1 seen from the rear side thereof.
Figure 4:
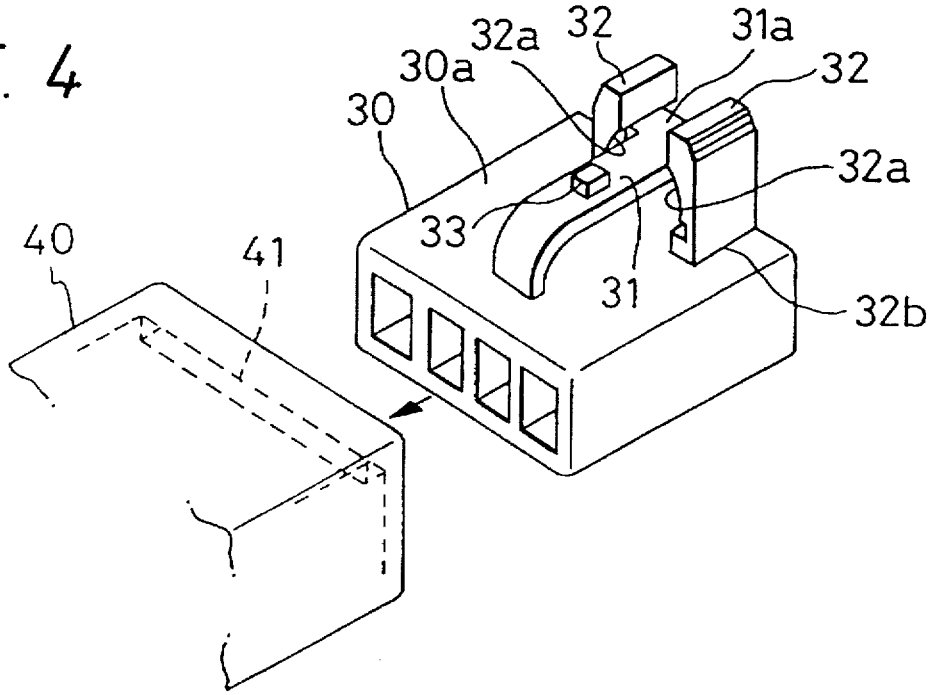
FIG. 4 is an exploded perspective view of a conventional connector structure.
Figure 5:
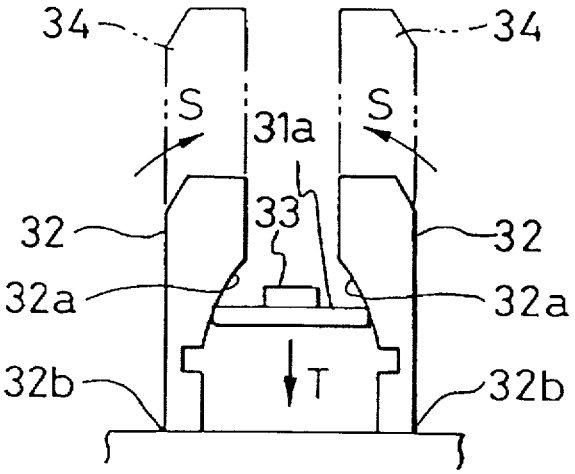
FIG. 5 is a diagram for a description of the function of the conventional connector structure shown in FIG. 4.

FIG. 1 is an exploded perspective view of the connector structure according to the invention. FIG. 2 is a sectional bottom view of the connector structure shown in FIG. 1. FIG. 3 is a rear view of the connector structure of the invention, for a description of the function of the latter.

The connector structure 1 of the invention comprises: a housing 3 which is engaged with a mating housing (not shown) and is able to accommodate terminals 2; an elastically deformable locking arm 10 which is integral with the housing 3, and locks the mating housing when the latter is engaged with the housing 3; and a rear holder 12 which is coupled to the rear end portion of the housing 3, to regulate the movement of the terminals mounted in the housing 3.

The rear holder 12 includes a pair of operating walls 20 and 20 which, when the rear holder 12 is coupled to the housing 3, are positioned near the free end portion of the locking arm 10 in such a manner that they are confronted with each other. The operating walls 20 are flexible. When pressed toward each other, the operating walls 20 are elastically bent to abut against the locking arm 10, to elastically bend the latter 10 downwardly; more specifically, to move the locking arm 10 down the inner surfaces of the operating walls 20.

The housing 3 has temporary locking protrusions 4 and final locking protrusions 5 on both (right and left) sides of the rear end portion (only the protrusions 4 and 5 on the left side being shown). A water-proof plug 6 is fitted in the rear end of each of the terminal accommodating chambers (not shown) accommodating the terminals 2. The terminals 2 inserted into the terminal accommodating chambers are passed through the water-proof plugs 6, thus being exposed. The housing 3 has a space 7 in the upper portion which allows the locking arm 10 to elastically deform.

The locking arm 10 is in the form of a flat plate, and its base portion (not shown) is extended from the upper end portion of the housing 3, and its free end portion 10*a* is extended along the upper end portion of the housing 3, and protruded from the rear end of the housing 3. A locking protrusion 11 is formed on the upper surface of the locking arm 10 in such a manner that it is engageable with an engaging groove (not shown) formed in the mating housing. When the locking protrusion 11 is engaged with the engaging groove, the housing 3 and the mating housing are positively locked to each other.

The rear holder 12 will be described in more detail. As shown in FIG. 2, the rear holder 12 is substantially U-shaped in its plan view. The right and left side walls of the rear holder 12, which are engaged with the right and left side walls of the housing 3, respectively, are partially inflated, thus forming guides 13 and 13 which guide the temporary locking protrusions 4 and the final locking protrusions 5. Those guides 13 and 13 have upper locking grooves 14 and lower locking grooves 15 in the inner surfaces as shown in FIG. 1, which are engaged with the aforementioned temporary and final locking protrusions 4 and 5, respectively.

That is, the rear hold 12 is coupled to the housing 3 from below in such a manner that the temporary and final locking protrusions 4 and 5 are engaged with the guides 13. In this operation, the temporary locking protrusions 4 are first engaged with the upper locking grooves 14; that is, the rear holder 12 is temporarily locked to the housing 3. Under this condition, the terminals 2 can be set in the housing 3. When the terminals 2 have been set in the terminal accommodating chambers, the rear holder 12 is further moved upwardly, so that the temporary locking protrusions 4 are disengaged from the upper locking grooves 14 and engaged with the lower locking grooves 15, while the final locking protrusions 5 are engaged with the upper locking grooves 14. Thus, the rear holder 12 has been coupled to the rear end portion of the housing 3.

The rear holder 12 includes a locking wall 16 which is confronted with the rear end face of the housing 3 when the rear holer 12 is coupled to the rear end portion of the housing 3 in the above-described manner. The locking wall 16 is positioned below the terminal accommodating chambers when the rear holder is at the temporary locking position. Hence, under this condition, the water-proof plugs 6 and the terminals 2 are set in the housing 3.

When the rear holder is set at the final locking position, the locking wall 16 is brought into contact with the rear ends of the terminals 2 (cf FIG. 2), thus preventing the latter 2 from coming off. In this case, wires 8 connected to the terminals have been extended over the locking wall 16. Hence, the wires are bent by the locking wall 16 when latter 16 is set at the final locking position.

The aforementioned operating walls 20 are parts of the rear holder 32 which is coupled to the housing 3 from outside, and are confronted with each other. When the rear holder is coupled to the housing 3, each of the operating walls 20 is deformable (bendable) with its lower end 21 as a fulcrum. The operating walls 20 have unlocking portions 22 on the inner surfaces of their upper portions, respectively, which are confronted with each other. The unlocking portions 22 have unlocking surfaces 22*a* which are opened inwardly of the connector (downwardly in FIG. 3).

The function of the connector structure thus constructed will be described.

The rear holder 12 is moved upward from the lower portion of the housing 3, so that the temporary locking protrusions 4 and the final locking protrusions 5 are inserted in the guides 13. Then, the temporary locking protrusions 4 are engaged with the upper locking grooves 14, so that the rear holder 12 is set at the temporary locking position. Under this condition, the locking wall 16 is positioned below the terminal accommodating chambers of the housing 3. Hence, the waterproof plugs 6 can be set in the housing 3, and the terminals 2 can be inserted into the water-proof plugs 6.

The rear holder 12 is further moved upwardly, so that the final locking protrusions 5 are engaged with the upper locking grooves 14 while the temporary locking protrusions 4 are engaged with the lower locking grooves 15. Thus, the rear holder 12 has been set at the final locking position. Under this condition, the locking wall 16 is brought into contact with the rear ends of the terminals 2, thus preventing the latter 2 from coming off, and the wires 8 connected to the terminals are bent upwardly.

After the connector structure has been assembled in the above-described manner, the housing 3 is engaged with the mating housing. In this operation, the locking protrusion 11 is engaged with the engaging groove of the mating housing; that is, those housings are fixedly locked to each other.

With the connector structure thus assembled, the housing is unlocked from the mating housing as follows. First, the operating walls 20 is pressed towards each other from outside. As a result, as shown in FIG. 3, the operating walls 20 are bent in the directions of the arrows S with the lower ends 21 as fulcrums, so that the unlocking surfaces 22*a* and 22*a* of the operating walls 20 press against both side edges of the free end portion 10*a* of the locking arm 10. When both side edges of the free end portion 10*a* are pressed in the above-described manner, the locking arm 10 is moved down (in the direction of the arrow T in FIG. 3) along the unlocking surfaces 22*a* and 22*a*. Accordingly, the locking protrusion 11 is disengaged from the locking groove of the mating housing. Thus, the housing 3 of the connector structure has been unlocked from the mating housing.

As was described above, in the connector structure of the invention, the operating walls adapted to elastically deform (bend) the locking arms are formed on the rear holder which is engaged with the housing to regulate the movement of the terminals in the housing. When the rear holder is engaged with the housing, the operating walls are elastically bent with their lower ends as fulcrums which are located below the center of the housing.

Hence, the operating walls are long enough to be elastically bent; that is, it is unnecessary to lengthen the operating walls above the housing. This feature makes it possible to readily bend the operating walls although the connector is not bulky.

Furthermore, since the operating walls are not extended above the housing, the rear holder is free from a difficulty that, when molded, its surfaces are sunk by thermal contraction. That is, the rear holder is fine in configuration.

Moreover, the operating walls are formed on the rear holder which is provided separate from the housing. The material of the rear holder may be different from the material of the housing. Hence, a relatively inexpensive material may be employed for formation of the rear holder, which contributes to a reduction in manufacturing cost of the connector.

The locking arm is extended from the rear end of the housing, and the operating walls are held abutted against both side edges of the locking arm. Therefore, when the operating walls are pressed towards each other, the locking arm is moved down the inner surfaces of the operating walls, being bent downwardly. That is, the locking arm is operated with forces pressing the operating walls from both sides of the connector. This feature means that the space over the connector is not limited.

The wires connected to the terminals in the housing are led out after being bent by the locking wall of the rear holder. Hence, even if a tensile force is applied to the wires, it will not adversely affect the terminal connections.

What is claimed is:

1. A connector structure comprising:

a housing having a rear end portion;

a locking arm which is integral with said housing, and is engaged with a mating connector, said locking arm being elastically deformed to disengage from said mating housing;

a rear holder including at least one locking groove which is coupled to a locking protrusion of the rear end portion of said housing, and regulates movement of terminals accommodated in said housing; and flexible operating walls with unlock portions herein, which are able to be pressed towards each other and said locking arm to engage with both side edges of said locking arm, thereby to elastically deform said locking arm downwardly;

wherein said operating walls are formed on said rear holder; and wherein said operating walls are bendable with lower ends thereof as fulcrums which are located below a center of said housing, wherein the rear holder may be made of optionally selected material different from the housing.

2. A connector structure as claimed in claim 1, wherein said locking arm is extended from the rear end portion of said housing; said rear holder is substantially U-shaped in a plan view thereof, and is coupled to said housing from outside; said operating walls are comprised of a pair of walls of said rear holder which are confronted with each other; and said operating walls are arranged to be opposite to side portions of said locking arm.

3. A connector structure as claimed in claim 1, wherein said rear holder includes a locking wall, and wires connected to said terminals are extended out of said housing after being bent by said locking wall.

* * * * *